356-400
1/14/86 XR 4,564,085

United States Patent [19]

Melocik et al.

[11] Patent Number: 4,564,085

[45] Date of Patent: Jan. 14, 1986

[54] CONTROLLING ARRANGEMENT

[75] Inventors: Grant C. Melocik, Chardon; John E. Wible, Painesville, both of Ohio

[73] Assignee: Towmotor Corporation, Mentor, Ohio

[21] Appl. No.: 693,415

[22] Filed: Jan. 22, 1985

[51] Int. Cl.[4] ..... B66B 9/20

[52] U.S. Cl. ..... 187/9 R; 187/28; 414/273; 414/674; 250/222.1; 356/400

[58] Field of Search ..... 187/9 E, 9 R, 1 R, 28; 414/273, 274, 275, 674; 250/222.1, 223 R; 356/375, 399, 400

[56] References Cited

U.S. PATENT DOCUMENTS

| | | | |
|---|---|---|---|
| 3,672,470 | 6/1982 | Ohntrup et al. | 187/1 |
| 3,824,020 | 7/1974 | Pease | 414/274 X |
| 3,973,685 | 8/1976 | Loomer | 214/16 |
| 4,105,339 | 8/1978 | Wirtanen | 356/400 X |
| 4,212,375 | 7/1980 | Peterson et al. | 187/9 |
| 4,328,422 | 5/1982 | Loomer | 250/239 |
| 4,441,817 | 4/1984 | Pryor | 356/375 |
| 4,502,823 | 3/1985 | Wronski et al. | 356/375 X |

FOREIGN PATENT DOCUMENTS

| | | | |
|---|---|---|---|
| 708047 | 4/1965 | Canada | 187/9 R |
| 0135653 | 11/1978 | Japan | 356/400 |
| 946074 | 1/1964 | United Kingdom | 356/400 |

*Primary Examiner*—Joseph J. Rolla
*Assistant Examiner*—Nils E. Pedersen
*Attorney, Agent, or Firm*—Alan J. Hickman

[57] ABSTRACT

Controlling arrangements of the type used for aligning a load engaging assembly with a load to be lifted tend to be bulky, costly, unable to accurately position the load engaging assembly with the load to be lifted, and unable to accommodate different types of load supporting structures. A controlling arrangement having a signal assembly having first and second spaced apart portions is provided. The first portion is adapted to deliver a first signal and receive a reflection of the first signal and the second portion is adapted to deliver a second signal and to receive a reflection of the first signal. A single sensing device is adapted to receive the reflected signals and a selecting device controls the operation of the first and second signal assembly portions. Therefore, the problems of bulk, cost, inaccuracy and flexibility are eliminated. The controlling arrangement is particularly suited for use on a material handling vehicle.

13 Claims, 4 Drawing Figures

56
98
50
33
114
119
116
110
94
96
118
102
111
104
76
106
82
70
62
109
110
108
100
58
78
73
52
84
60
22
86
68
48
75
124
122
120
76
74
66
22
80
54
64
72

CONTROLLING ARRANGEMENT

DESCRIPTION

1. Technical Field

This invention relates to a controlling arrangement suitable for use with a load engaging assembly, and more particularly to a controlling arrangement for selectively engaging different types of load supporting structures.

2. Background Art

Control systems for automatically positioning a load handling device relative to a load to be lifted have been known for some time. An example of such a system is shown in U.S. Pat. No. 3,672,470 to Frederick F. Ohntrup et al, dated June 27, 1972 in which a light source and a light sensitive device are provided on the forks of the load handling device. One problem with such a system is that unless a reflective target is provided on or associated with the load to be lifted the range and accuracy of the system is less than desirable and often inadequate.

The addition of a reflective target to the load or load supporting structure to be lifted significantly improves the range and accuracy of the system, but substantially reduces flexibility. This reduction in flexibility is due to the inability of always positioning the target at the same location relative to the engageable portion of the load or load supporting structure to be lifted. For example, on a pallet, the location of the target relative to the fork engageable portion of the pallet is different than the location of the target on a tote box relative to the fork engageable portion of the tote box. Therefore, a single light source and light sensitive device is not capable of aligning the forks with more than one type of load supporting structure.

There is a limited amount of space available for locating a control system capable of performing as heretofore discussed. Therefore, the possibility of adding a signal source and signal sensor for each type of load supporting structure to be lifted is unlikely. This is particularly true in applications where the sensing device is a charge coupled device having a substantially large envelope. Also, the cost involved in adding a sensor for each source provided is prohibitive.

Further, it is necessary to prevent more than one reflected signal from being directed to the sensor at a given time so that only the desired type of load supporting structure to be lifted is involved in the reflection process.

The present invention is directed to overcoming one or more of the problems as set forth above.

DISCLOSURE OF THE INVENTION

In one aspect of the present invention, a controlling arrangement has a signal assembly, a single sensing device and a selecting device. The signal assembly has a first portion for delivering a first signal and receiving a reflection of the first signal, and a second portion for delivering a second signal and receiving a reflection of said second signal. The single sensing device is adapted to receive reflected signals from the first and second portion and deliver a control signal. The selecting device energizes or actuates one of the first and second portions.

In another aspect of the present invention, a load lifting device has a load engaging assembly. A signal assembly having a first portion is adapted to deliver a first light beam and to receive a reflection of said first light beam, and a second portion is adapted to deliver a second light beam and to receive a reflection of said second light beam. The signal assembly is connected to the load lifting device and movable with the load lifting device. A single optical sensing device is mounted on the load lifting device and adapted to receive a reflection of each of the light beams and deliver a control signal in response thereto. A selecting device functions to direct only a selected one of the first and second reflected signals to the single optical device.

In still another aspect of the present invention, a material handling vehicle is adapted to lift a first load supporting structure having a first reflective target and a second load supporting structure having a second reflective target is provided. A load engaging assembly is movably mounted on the vehicle and has an apparatus for moving the load engaging assembly between elevationally spaced apart locations. A signal assembly having first and second spaced apart portions and a single optical sensing device are connected to said load engaging assembly. The first portion is adapted to deliver a first light beam and receive a reflection of the first light beam in response to alignment between the first portion and the first target. The second portion is adapted to deliver a second light beam and receive a reflection of the second light beam in response to alignment between the second portion and the second target. The optical sensing device is adapted to receive the reflected light beam and deliver a control signal in response to receiving the reflection. A receiving device receives the control signal and stops elevational movement of the load engaging assembly at an aligned position of one of the first and second portions and a respective one of the first and second targets. A selecting device controls the operation of the signal assembly and delivers only a selected one of the reflections of the first and second light beams to the single optical device.

This controlling arrangement solves the problem of load alignment for more than one type of load supporting assembly by providing a signal assembly with first and second spaced apart portions each of which are adapted to deliver a signal and receive a reflection of the respective signal.

The selecting device enables a single sensing device to be used to receive more than one reflection, but not at the same time. Thus, the controlling arrangement is of a size sufficiently small for attachment to a load engaging assembly. Also, by utilizing a single sensing device, the cost is reduced substantially and allows the controlling arrangement to be used in highly cost sensitive applications.

BEST MODE FOR CARRYING OUT THE INVENTION

Figure 1:
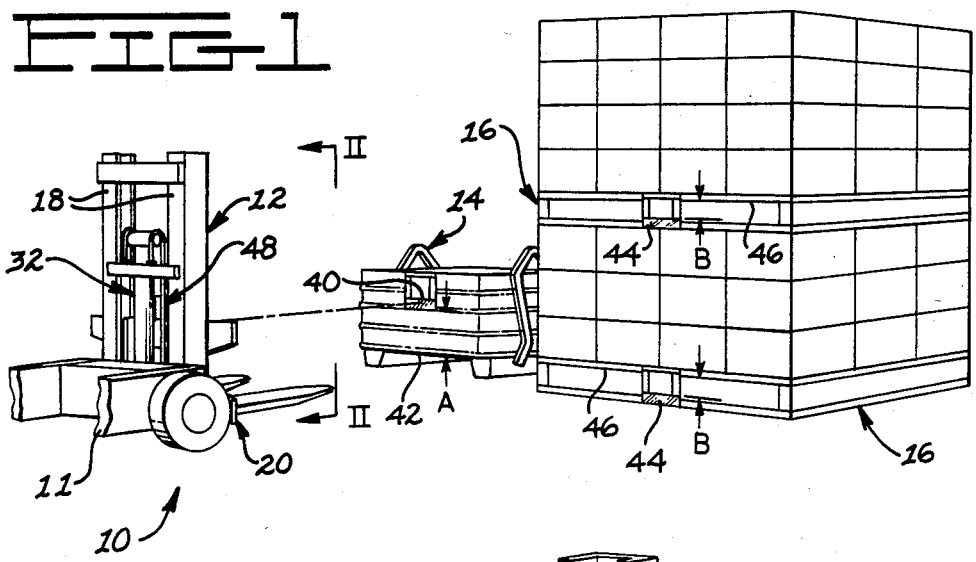
FIG. 1 is a partial diagrammatic isometric view of an embodiment of the present invention showing a portion of a material handling vehicle having a load lifting device, a controlling arrangement, and first and second load supporting structures upon which first and second targets respectively are mounted.
Figure 2:
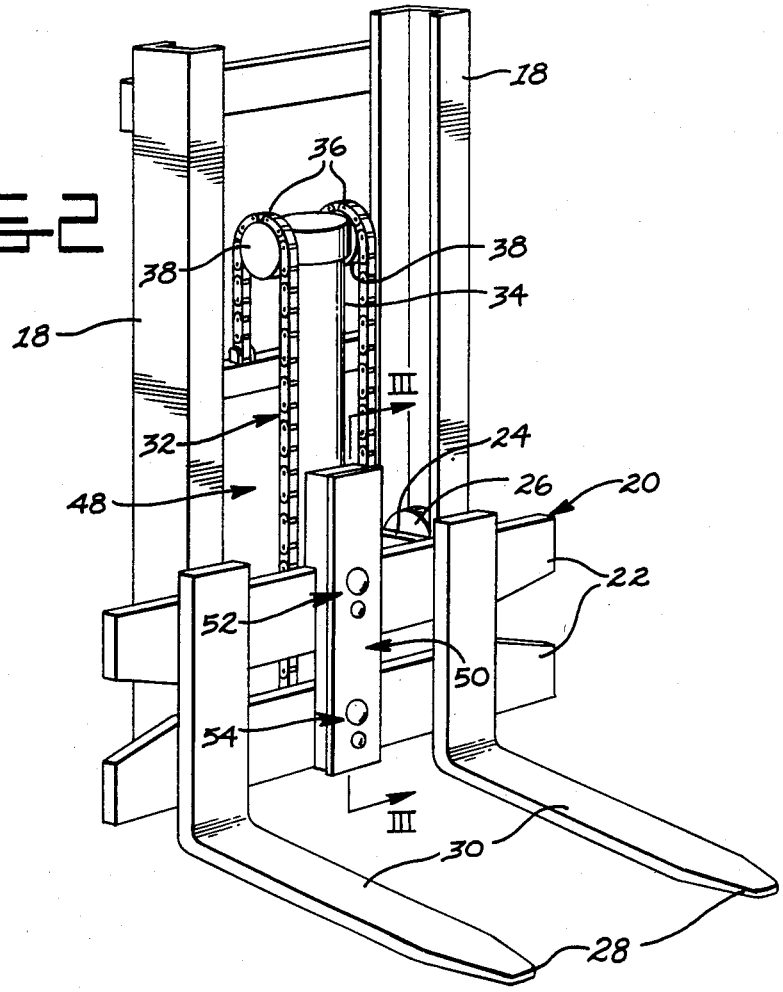
FIG. 2 is a diagrammatic view taken along lines II—II of FIG. 1 showing the load lifting device in greater detail, including a load engaging assembly, and showing the location of first and second signal assembly portions of the controlling arrangement.

With reference to FIGS. 1 and 2, a material handling vehicle 10 has a frame 11, a load lifting device 12 mounted on the frame 11 for lifting first and second types of load supporting structures 14 and 16. The vehicle 10 is preferably of the type referred to as an automatic guided vehicle (AGV), however, other vehicles having the ability to transport loads are contemplated for use of this invention. The load lifting device 12 has a pair of spaced apart uprights 18, and a load engaging assembly 20 mounted on and movable along said uprights 18 between elevationally spaced apart locations.

The load engaging assembly 20 has a support frame 22, a pair of roller brackets 24 (only one shown) connected to said support frame 22, a plurality of rollers 26 (only one shown) connected to said roller brackets and rollingly engaged with said uprights 18, and a pair of forks 28 mounted on said support frame 22. Each of the forks 28 has a load engaging portion 30 which extends from the support frame 22 in a direction suitable for engaging a load to be lifted which is resting upon either first or second types of load supporting structures 14 and 16. The first and second load supporting structures 14 and 16 are shown as a tote box and a pallet, respectively. However, these are only two examples of the many types commercially available today. Any reference to the specific type of structure is only for purposes of illustration and not to be considered as a limitation.

A power means 32 is connected to and moves the load engaging assembly 22 between the aforementioned elevationally spaced apart locations. The power means 32, as shown, includes a jack 34 mounted on the load lifting device 12, a pair of chains 36 trained over a respective pair of sheeves 38 mounted on the jack 34. The chains are each connected at opposed ends to the uprights 18 and load engaging assembly 20 and are movable in response to elevational movement of the sheaves 38 by extension and retraction of the jack 34. Preferably, the jack is fluid operated.

As best seen in FIG. 1, the first type of load supporting structure 14 has a first target 40 of any suitable configuration mounted on the structure 14 at a preselected location and spaced a distance "A" from a surface portion 42 of the first structure which is engageable by the load engaging portion 30 of the load engaging assembly 20. The first target 40 has excellent light reflecting qualities and is of a size sufficient to reflect a beam of light aimed at the target from a distance of at least 4 meters. For example, the target may be made of reflective tape, polished metal, and the like, preferably mirror glass. Similarly, the second type of load supporting structure 16, two of which are shown, has a second target 44 of any suitable configuration mounted on the second structure 16 at a preselected location spaced a preselected distance "B" from a surface portion 46 of the second structure 16. The second target 44, like the first target 40, must have excellent reflective qualities and be of a size sufficient to reflect a beam of light aimed from at least 4 meters. The second target, like the first, may be made of any suitable reflective material, preferably mirror glass.

A controlling arrangement 48 is provided for positioning the load engaging assembly 20 at the proper elevational location at which the forks 30 are aligned to engage a selected one of the first and second types of load supporting structures 14,16. The controlling arrangement 48 includes a signal assembly 50 moving first and second spaced apart portions 52 and 54, a single sensing device 56, and means 58 for selectively energizing or actuating one of the first and second portions 52 and 54 of the signal assembly 50.

The first portion 52 is adapted to deliver a first signal 60 and receive a reflection 62 of the first signal and the second portion 54 is adapted to deliver a second signal 64 and receive a reflection 66 of the second signal. The first portion 52 is preferably mounted on the load engaging assembly 20 at a preselected transverse location relative to the uprights 16, between the uprights 18, and at an elevation relative to the load engaging portion 30 of the forks 28 that is substantially equal in magnitude to distance "A", for example 0.5 meters. Similarly, the second portion 54 is preferably mounted on the load engaging assembly 20 at a transverse location relative to the uprights 18, between the uprights 16, and at an elevation relative to the load engaging portion 30 of the forks 28 that is substantially equal in magnitude to distance "B", preferably about 0.1 meters. It should be noted that the specific location of the first portion 52 is a function of the position of the first reflective target 40 relative to the surface portion 42, and the specific location of the second portion 54 is a function of the location of the second reflective target 44 relative to the surface portion 46.

The first portion 52 includes a first source of light 68 and a first lens 70 mounted adjacent one another on the load engaging assembly 20, and the second portion 54 includes a second source of light 72 and a second lens 74 mounted adjacent one another on the load engaging assembly 20. The first signal 60 is therefore preferably a first light beam delivered from the first source of light 68 and the second signal 64 is therefore preferably a second light beam delivered from the second source of light 72. The preselected location of the first source of light 68 enables the first lens 70 to receive a reflection of the first light beam of sufficient intensity only at an elevationally aligned positioned of the first reflective target 40 and the first signal assembly portion 52. The second lens 74 receives a reflection of the second light beam of sufficient intensity only at an elevationally aligned position of the second reflective target 44 and the second signal assembly portion 54.

Figure 3:
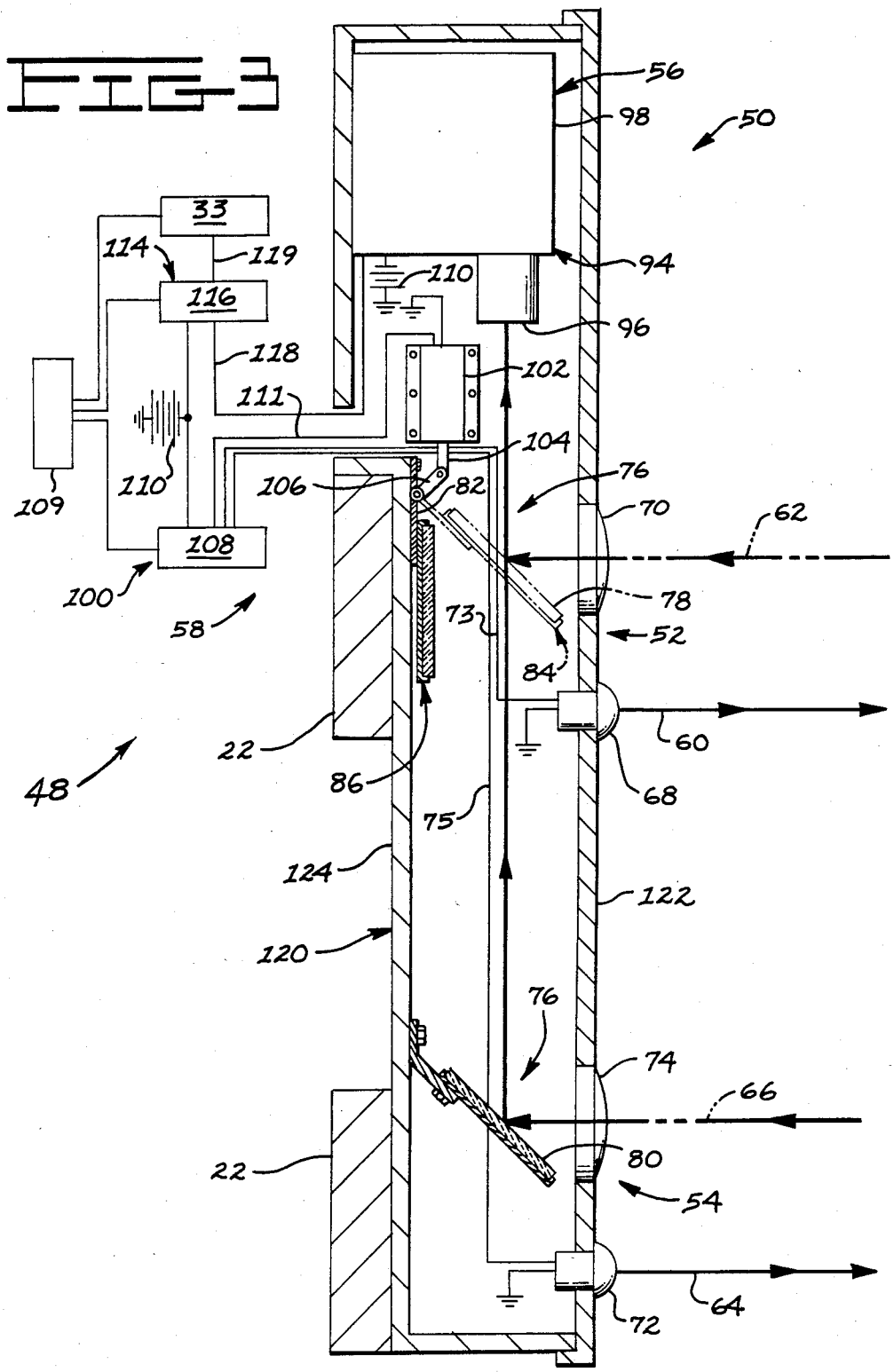
FIG. 3 is a diagrammatic sectional view taken along lines III—III of FIG. 2 showing one embodiment of the controlling arrangement in greater detail.
Figure 4:
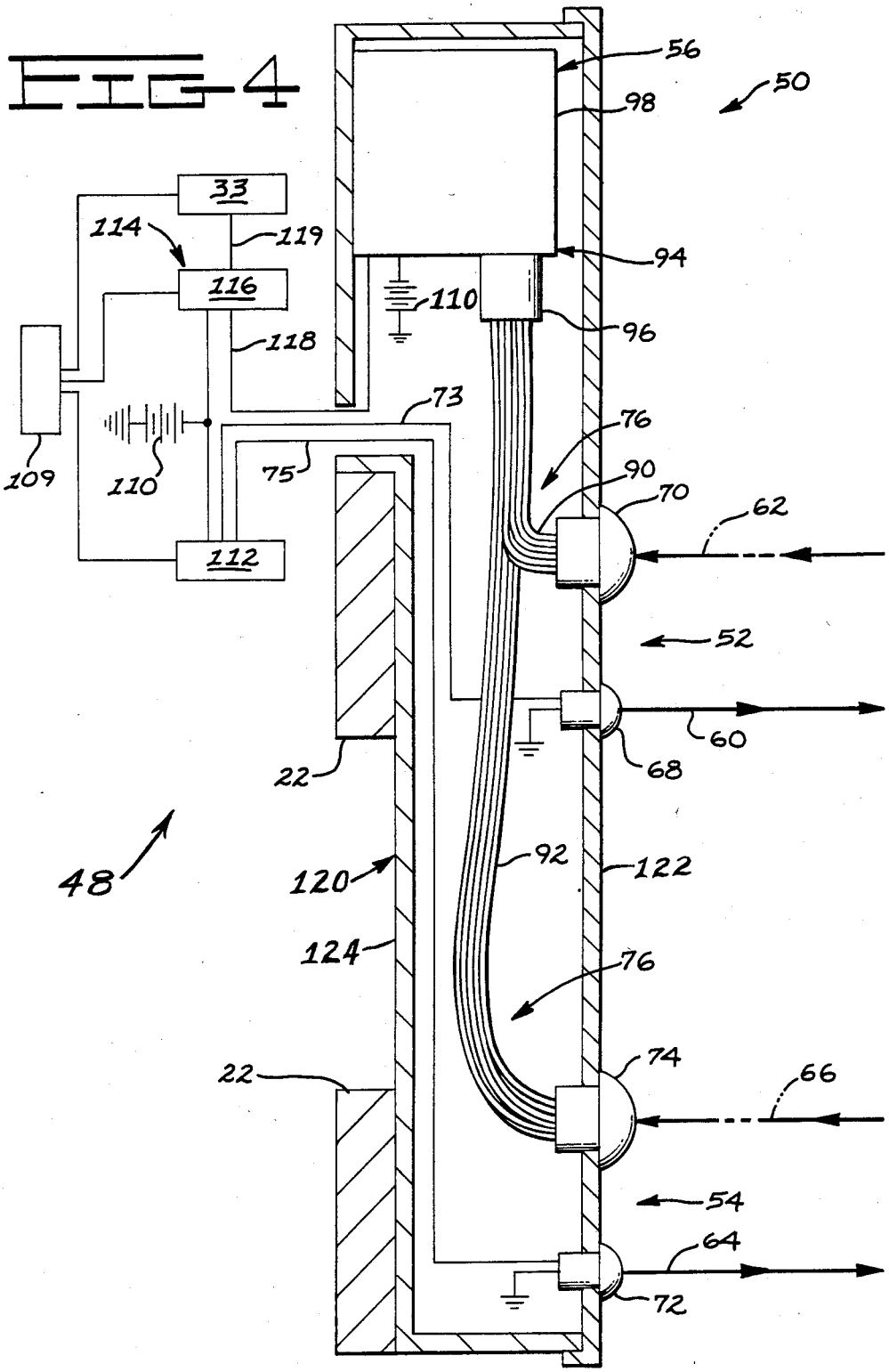
FIG. 4 is a diagrammatic alternate embodiment of the controlling arrangement of FIG. 3.

As best seen in FIGS. 3 and 4, the selecting means 58 includes a means 76 for directing the reflected signal received by the first and second signal assembly portions 52 and 54 to the single sensing device 56. In FIG. 3, the directing means 76 includes a first mirror 78 mounted on the load engaging assembly 20 adjacent the first lens 70 so that the reflected light 62 received by the first lens 70 is passed by the first lens 70 to the first mirror 78 and reflected by the first mirror 78 to the single sensing device 56. The directing means 76 also includes a second mirror 80 mounted on the load engaging assembly 20 adjacent the second lens 74 so that the reflected light 66 received by the second lens 74 is passed by the second lens 74 to the second mirror 80 and reflected by the second mirror 80 to the single sensing device 56.

The first mirror 78 is preferably disposed between the second mirror 80 and the single sensing device 56 and pivotally connected to the load engaging assembly 20 by a hinge assembly 82. The first mirror 78 is pivotally movable between a first angular position 84 at which the first reflected signal 62 passed by the first lens 70 is directable by the first mirror 78 to the single sensing device 56, and a second angular position 86 at which the first reflected signal 62 passed by the first lens 70 is directed by the first mirror 78 in any direction other than toward the single sensing device 56.

In this embodiment, the first mirror 78, at the second position 86, directs the first reflected signal back toward the first lens. The second mirror 80 is connected to the load engaging assembly 20 by a bracket 88 capable of maintaining the second mirror at the proper location and at a proper angular position relative to the second lens 74 and single sensing device 56. The second mirror 80, at the first position 84, directs the second reflected signal 66 passed by the second lens 74 along substantially the same or a closely adjacent pathway. Therefore, with the first mirror 78 at the first position 84, any reflection of the second signal 76 is obstructed by the first mirror 78 and blocked from the single sensing device 56. Conversely, with the first mirror 78 at the second position 86, the second reflected signal 66 is directed past the first mirror and to the single sensing device 56. It should be noted that the lenses 70,74 are positioned to focus the reflected signal directed onto the adjacent mirror 78,80 when the reflecting target 40,44 and the respective lenses 70,74 are elevationally and transversely aligned.

With reference to FIG. 4, the directing means 76 of this embodiment includes a first fiber optic bundle 90 disposed between the first lens 70 and single sensing device 56, and a second fiber optic bundle 92 disposed between the second lens 74 and the single sensing device 56. The first and second fiber optic bundles 90 and 92, like the first and second mirrors, are adapted to direct the first and second reflected signals 62,66 from respective first and second lenses 70,74 to the single sensing device 56.

The single sensing device 56 is preferably a charge coupled device 94 having a signal receiving port portion 96 and a control portion 98 and being adapted to deliver a control signal in response to receiving one of the first and second reflected signals 62,66. Preferably the charged coupled device 94 is light sensitive and capable of delivering the control signal only when a selected one of the first and second portions 52 and 54 are aligned with a respective one of the first and second targets 40 and 44. For example, only when aligned is the reflected signal of sufficient intensity to cause the control portion 98 to deliver a control signal. Parameters other than light intensity can be used to trigger the control portion 98 to deliver a control signal and are to be considered equivalents and within the scope of this invention.

With reference to FIG. 3, the selecting means 58 which controls the operation of the signal assembly 50 includes means 100 for moving the first mirror between said first and second positions 84,86. The moving means 100 preferably includes a two position solenoid 102 which is normally spring biased to one of the two positions and mounted on the load engaging assembly 20. The solenoid 102 has a plunger 104 connected to the hinge assembly 82 via a link and pin assembly 106. Pivotal movement of the assembly 106 in response to movement of the solenoid plunger 104 between the two positions causes pivotal movement of the first lens 78 between its first and second positions 84,86. It is to be noted that the linear solenoid heretofore described may be replaced by a rotary motor of suitable design without departing from the spirit of this invention.

A second means 108 selectively passes electrical current from a source 110 to the solenoid 102 via conduit 111 and moves the plunger and the first mirror 78 between the first and second positions 84,86. It is to be noted that the second means 108 includes either a manual switching device controlled by an operator (not shown) or an electronic switching device controlled by a computer 109. In either case the second means 108 is capable of actuating the solenoid and moving the mirror when the second type of load supporting structure 16 is to be engaged.

Alternately, a first means 112 (see FIG. 4) is provided for selectively passing electrical current from said source 110 to a selected one of the first and second sources of light 68,72 via connectors 73,75. The first means 112, for example, includes a mechanical switching device manually actuatable by a vehicle operator or an electronic switching device controlled by a computer 109. In either case, the first means 112 actuates one of the first and second light sources 68,72 corresponding to the load supporting structure 14,16 to be lifted. It is to be noted that when the first means 112 for selectively passing is utilized, the second means 108 for selectively passing is not required and vice versa. In addition, the first mirror 78 may be rigidly mounted and not pivotal. In such a situation the first means 112 is required to maintain proper operation of the system and to distinguish between the type of load to be engaged by preventing both the first and second signals 60,64 from being directed to the single sensing device 56 at the same time.

A means 114 receives the control signal delivered from the control portion 98 of the single sensing device 56 and stops movement of the load engaging assembly at an elevationally aligned position of one of the first and second portions 52,54 of the signal assembly 50 and a respective one of the first and second targets 40,44. Specifically, the means 114 includes a switching device 116 connected to the control portion 98 via conductor 118 and to the power means 32 via conductor 119. The switching device 116 is responsive to the signal passed by the control portion 98 for terminating operation of the power means 32. For example, the power means 32 includes a solenoid operated valve 33 connected to the jack 34 and adapted to pass fluid flow from a pump (not shown) to the jack 34 only when the switching device 116 is actuated to pass electrical current to the solenoid operated valve 33. It should be recognized by those skilled in the art that there are alternate approaches to control the power means 32 in addition to that discussed herein. These alternative means are considered to be within the scope of the present invention.

The controlling arrangement 48, and more specifically the signal assembly 50, the single sensing device 56, and the selecting means 58, are disposed within a housing 120 which is mounted on the support frame 22. Preferably, the housing 120 has a cover 122 which is removably and sealingly connected to a base 124. Thus, the controlling arrangement 48 is substantially protected from dirt, moisture and the like.

Industrial Applicability

With reference to the drawings, the controlling arrangement 48 is best suited for applications wherein the vehicle 10 is of the driverless type and more than one type of load supporting structure is provided. Preferably, the on board computer 109 controls vehicle operation in accordance with programmed instructions. These programmed instructions include both vehicle travel instructions and load lifting instructions. The travel instructions include the path the vehicle is to follow about the facility and the approximate location of the load pick up and deposit zones. The load lifting instructions would include items such as the type of load to be engaged, the approximate elevational location of the load, and other information related to load engagement and deposit.

A typical material handling operation includes transporting a load from a pick up location to a deposit location. Assuming that the load to be picked up is of the second type 16, the vehicle 10, under guidance of the computer, would approach the load at the pick up location. Prior to reaching the pick up location the computer 109 delivers a signal to the selecting means 58 and conditions the signal assembly 50 for alignment with the second load type 16. In FIG. 3 the second means 108 is actuated by the computer and passes electrical current from the source 110 to the solenoid 102 and moves the first mirror 78 from the first position 84 to the second position 86 and only the second reflected signal 66 is directed to the single sensing device 56. In FIG. 4, the first means 112 is actuated by the computer to pass electrical current from the source 110 to only the second source of light 72. In either case only light from the second source 72 is reflectable to the single sensing device 56.

As the vehicle 10 closes in on the second type of load supporting structure 16 the computer actuates the power means 32 to move the load engaging assembly 20 elevationally along the uprights 18. When the load engaging assembly 20 is at the proper elevational and transverse location relative to the load to be lifted, the forks 28 are aligned to fit beneath the surface portion 46 of the second structure 16. At this position the reflection of the second signal 66 is aligned with and received by the second lens 74, and delivered by the second lens 74 to the single sensing device 56. The second reflected signal 66 is adequately directed to and received by the single sensing device 56 only upon alignment.

Upon reaching the aligned position between the second target 44 and the second signal assembly portion 54, the control portion 98 of the single sensing device 56 delivers a signal to means 114. Upon receiving the control signal from the control portion 98, the means 114 stops elevational movement of the load engaging assembly 20 and the vehicle 10 is moved into the load for lifting. The computer 109 then instructs the power means 32 to lift the load and instructs the vehicle 10 to transport the load to the desired deposit location.

To pick up a load of the first type, a similar procedure is followed. However, either the first mirror 78 is moved to the first location to block the second reflected signal 66 from the single sensing device 56 and to pass the first reflected signal 62 to the single sensing device 56, or the first means 112 is actuated to pass electrical current to the first light 68 only.

It should be noted that the selecting means 58 prevents both the first and second reflected signals 62 and 66 from being simultaneously directed to the single sensing device. Therefore, a single sensor 56 is capable of performing as two separate sensing devices which certainly reduces the size of the controlling arrangement 48 envelope and permits mounting on the support frame 22.

The provision of the signal assembly 50 having two or more portions 52 and 54 each being adapted to deliver and receive a separate signal makes it possible to automatically align the load engaging assembly 20 with two or more types of loads to be lifted 14 and 16.

Because the controlling arrangement 48 utilizes targets 40 and 44, lenses 70 and 74, and directing means 76, the accuracy of alignment between the type of load 14 and 16 to be lifted and the load engaging assembly 20 is more precise and reduces the potential for load damage due to misalignment.

Other aspects, objects and advantages of this invention can be obtained from a study of the drawings, the disclosure and appended claims.

We claim:

1. A controlling arrangement, comprising:

a signal assembly having first and second spaced apart portions, said first portion being adapted to deliver a first signal and receive a reflection of said first signal, and said second portion being adapted to deliver a second signal and receive a reflection of said second signal;

said first signal assembly portion having a first source of light and a first lens, and said second signal assembly portion having a second source of light and a second lens, said first signal being a light beam delivered from the first source of light and said second signal being a light beam delivered from the second source of light, said first lens being adapted to receive a reflection of the first light beam and said second lens being adapted to receive a reflection of the second light beam, said lenses each being adapted to pass the received light beam reflection;

a single sensing device adapted to receive the reflected signals from each of said first and second signal assembly portions and deliver a control signal in response thereto;

means for selectively actuating one of the first and second portions of said signal assembly;

means for directing the reflected signals received by the first and second portions to the single sensing device, said directing means includes a first mirror positioned between the first lens and said single sensor, said first mirror being adapted to direct reflected light passed by the first lens to said single sensing device, and a second mirror positioned between the second lens and said single sensing device, said second mirror being adapted to direct reflected light passed by the second lens to said single sensing device.

2. The controlling arrangement as set forth in claim 1, wherein said means for selectively actuating includes:

a source of electrical current; and a first means for selectively passing electrical current from said source of electrical current to a selected one of said sources of light.

3. The controlling arrangement, as set forth in claim 1, wherein said first mirror is positioned between said second mirror and said single sensor and said means for selectively actuating includes means for moving said first mirror between a first position at which reflected light directed by said second mirror is blocked from said single sensing device, and a second position at which reflected light directed by said second mirror is passable to said single sensing device.

4. The controlling arrangement, as set forth in claim 3, wherein said means for moving includes a solenoid connected to said first mirror and adapted to move said first mirror between said first and second positions.

5. The controlling arrangement, as set forth in claim 1, wherein said single sensing device is a single optical sensor having a signal receiving portion and a control signal delivering portion, said signal receiving portion being adapted to receive said first and second reflected signals.

6. The controlling arrangement, as set forth in claim 5, wherein said single optical sensor is a charge coupled device.

7. A load lifting device, comprising:

a load engaging assembly moveable between spaced apart locations;

a signal assembly having first and second spaced apart portions and being connected to said load engaging assembly, said first portion being adapted to deliver a first light beam and to receive a reflection of said first light beam, and said second portion being adapted to deliver a second light beam and to receive a reflection of said second light beam, said first portion includes a first source of light and a first lens, and said second portion includes a second source of light and a second lens, said first source of light and said first lens being mounted at a preselected location on the load engaging assembly, and the second source of light and second lens being mounted on said load engaging assembly at a preselected location spaced from the first source of light and first lens, said first source of light being adapted to deliver said first light beam and said first lens being adapted to receive the reflection of said first light beam, and said second source of light being adapted to deliver said second light beam and said second lens being adapted to receive the reflection of said second light beam, said lenses being adapted to pass the reflected light beams received;

a single optical sensing device mounted on said load engaging assembly, said single optical sensing device being adapted to receive the reflection of said first and second light beams and deliver a control signal in response thereto;

means for selectively actuating said signal assembly and directing only a selected one of said first and second reflected beams to said single optical sensing device, said means for selectively actuating includes;

means for directing the reflection of said first light beam passed by said first lens to said single optical sensing device, and for directing the reflection of said second light beam passed by the second lens to said single optical sensing device, and said means for directing includes;

a first mirror connected to said load engaging assembly at a preselected location adjacent the first lens, and a second mirror connected to said load engaging assembly at a preselected location adjacent the second lens.

8. The load lifting device, as set forth in claim 7, wherein said first mirror is pivotally connected to said load engaging assembly and said means for selectively actuating includes means for moving said first mirror between a first position at which the second light reflected beam directed by the second mirror toward the single optical sensing device is blocked by the first mirror from said single optical sensing device, and a second position at which the second reflected light beam is directed by the second mirror to said single optical sensing device, said first mirror directing the first reflected light beam toward said single optical sensing device at the first position thereof and directing the first light reflected beam in a direction other than toward said single optical sensing device at the second position thereof.

9. The load lifting device, as set forth in claim 8, wherein said means for moving includes:

a solenoid mounted on said load engaging assembly and being connected to said first mirror, said solenoid being adapted to move said first mirror between said first and second positions;

a source of electrical current; and second means for selectively passing electrical current from said source of electrical current to said solenoid and moving said first mirror from one of said first and second positions to the other of said first and second positions.

10. The load lifting device, as set forth in claim 7, wherein said means for selectively actuating includes;

a source of electrical current; and first means for selectively passing electrical current from said source of electrical current to a selected one of said sources of light.

11. A material handling vehicle for lifting a selected one of first and second types of load supporting structures, comprising:

a first reflective target mounted at a preselected elevational location on said first type of load supporting structure, said first type of load supporting structure having a surface portion spaced a preselected distance "A" from said first reflective target;

a second reflective target mounted at a preselected elevational location on said second type of load supporting structure, said second type of load supporting structure having a surface portion spaced a preselected distance "B" from said second target; said preselected distance "A" having a greater magnitude than distance "B";

a vehicle frame;

a load engaging assembly mounted on said vehicle frame and being moveable between elevationally spaced apart locations, said load engaging assembly having a load engaging portion, said load engaging portion being adapted to engage the surface portion of a selected one of said first and second load supporting structures;

power means for moving said load engaging assembly between said elevationally spaced apart locations;

a signal assembly having first and second spaced apart portions and being connected to said load engaging assembly, said first portion being adapted to deliver a first light beam and to receive a reflection of said first light beam in response to elevational alignment of said first signal assembly portion and said first target, and said second signal assembly portion being adapted to deliver a second light beam and to receive a reflection of said second light beam in response to elevational alignment of said second signal assembly portion and said second target, said first portion being elevationally spaced from said load engaging portion a distance substantially equal in magnitude to distance "A" and said second portion being elevationally spaced from said load engaging portion a distance substantially equal in magnitude to distance "B";

a single optical sensing device connected to said load engaging assembly, said optical sensing device being adapted to receive the reflections of said first and second light beams and deliver a control signal in response thereto;

means for receiving said control signal and stopping elevational movement of said load engaging assembly at the elevationally aligned position of one of the first and second portions and a respective one of said first and second targets;

means for directing said first and second received light beam reflections to said single optical sensing device; and means for selectively actuating said directing means to deliver only a selected one of the reflections of said first and second light beams to said single optical sensing device.

12. The material handling vehicle, as set forth in claim 11, wherein said directing means includes:

a first mirror mounted on said load engaging assembly at a location between said first portion and said optical sensing device; and a second mirror mounted on said load engaging assembly at a location between said first portion and said optical sensing device.

13. The material handling vehicle, as set forth in claim 12, wherein said first portion includes a first lens and a first source of light, and said second portion includes a second lens and second source of light, said lenses and lights each being mounted on said load engaging assembly at elevationally spaced apart locations.

* * * * *